US006206716B1

(12) United States Patent
Saito

(10) Patent No.: US 6,206,716 B1
(45) Date of Patent: Mar. 27, 2001

(54) CONNECTOR

(75) Inventor: Hitoshi Saito, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/257,236

(22) Filed: Feb. 25, 1999

(30) Foreign Application Priority Data

Feb. 27, 1998 (JP) ..... 10-047755

(51) Int. Cl.[7] ..... H01R 13/627
(52) U.S. Cl. ..... 439/352
(58) Field of Search ..... 439/350, 351, 439/352, 353, 354, 355, 356, 357, 358, 445, 447

(56) References Cited

U.S. PATENT DOCUMENTS 5,487,678 * 1/1996 Tsuji et al. ..... 439/352
5,672,071 9/1997 Ceru ..... 439/353

* cited by examiner

*Primary Examiner*—Khiem Nguyen
(74) *Attorney, Agent, or Firm*—Armstrong, Westerman, Hattori, McLeland & Naughton, LLP

(57) ABSTRACT

A connector used for connecting automotive wiring harnesses consists of a first connector housing fittable to a second connector housing; a resilient locking means provided on the first connector housing, which rises at its forward base portion and extends rearwardly in a fitting direction of the first and second connector housings, the locking means including an operating means; a deformation prevention means provided on the first connector housing, within a width of the locking means for preventing an external force from acting on the locking means; and catching prevention means provided on laterally opposite sides of the operating means. The deformation prevention means protects the locking means from an external force.

9 Claims, 4 Drawing Sheets

CONNECTOR

BACKGROUND OF THE INVENTION

1. Field of the Invention

This invention relates to a connector for connecting automotive wiring harnesses and the like, and more particularly to a connector in which a resilient locking arm for locking female and male connector housings is protected from deformation.

2. Description of the Related Art

In FIG. 5, there is shown a male connector housing a with terminal receiving cavities a1 formed therein. Terminal lugs of a female type attached to wire ends of a wiring harness are received and locked in these terminal receiving cavities. The male connector housing a is fitted to a mating female connector housing containing terminal lugs of a male type (not shown) therein. On its upper wall, the male connector housing a has a resilient locking arm b which is elastically vertically movable relative to the upper wall and which engages with a female connector housing locking portion thereby to lock the connector housings together.

With the male connector housing a, if the resilient locking arm b is provided exposed on the housing upper wall, wires tend to catch an operating grip b1 at the rear end of the locking arm during assembly of the connector including insertion and locking of terminals, storage and transportation of wiring harnesses with such connectors, and the like, so that a sudden external force acts on, and damages to the resilient locking arm b. Arm protector walls c, c are thus provided on laterally opposite sides of the resilient locking arm b.

The male connector housing a' as shown in FIG. 6 has, in place of such arm protector walls c, a vertical recess d provided in an upper wall thereof for protecting a resilient locking arm b' therein.

Further, the male connector housing a as shown in FIG. 7 is featured by a pair of arm protector walls c, c provided on opposite sides of a resilient locking arm b" and a protector bridge e which links the protector walls at a rear side thereof.

With the conventional male connector housings a, a', as shown in FIGS. 5 and 6, however, a foreign body of a width smaller than that w between the protector walls c, c, or that of the vertical recess d, for example, a branch of a wiring harness, may enter between the protector walls c, c or the vertical recess d, resulting in an external force causing deformation of the resilient locking arms b or b'.

With the male connector housing a" of FIG. 7, the bridge e disposed on the protector walls c, c to cover the locking arm b" adds to the height of the connector housing. In addition, the operating grip b1" needs be located outside, beyond the bridge e, for the operation of the locking arm b". As a result, the connector becomes large in size, not complying with an increasing demand of miniaturization.

SUMMARY OF THE INVENTION

This invention has been accomplished to overcome the above drawbacks and an object of this invention is to provide a connector in which a foreign body of a width smaller than a width of resilient locking means is prevented from coming inside the width of the locking means and exerting a sudden external force on the locking means, and which suppresses an increase in the connector size.

In order to attain the object, according to this invention, there is provided a connector which comprises: a first connector housing fittable to a second connector housing; a resilient locking means for locking the first and the second connector housings together, provided on an outer wall of the first connector housing, the resilient locking means rising at a forward base portion thereof and extending rearwardly in a fitting direction of the first and the second connector housings, the resilient locking means including an operating means provided at a rear end thereof; a deformation prevention means provided on the outer wall of the first connector housing, within a width of the resilient locking means for preventing an external force from acting on the resilient locking means; and catching prevention means provided on laterally opposite sides of the operating means for keeping the operating means from catching a foreign body.

Preferably, the resilient locking means comprises a pair of resilient locking arms extending parallel to each other in the fitting direction of the first and the second connector housings, the operating means interconnects the pair of resilient locking arms at an end of the locking arms, and the deformation prevention means is interposed between the pair of resilient locking arms.

Preferably, the deformation prevention means comprises a horizontal rib extending parallel to the resilient locking arms and a vertical rib provided at a rear end of the horizontal rib, the vertical rib standing upright on a front side of the operating means.

Preferably, the operating means has a recess formed at a front side thereof and the vertical rib is located standing upright in side the recess.

Preferably, the connector further comprises a pair of locking segments provided on the respective resilient locking arms and together constituting a locking frame engageable with a corresponding locking means provided on the second connector housing to lock the first and the second connector housings together.

Preferably, the deformation prevention means comprises a vertical rib standing upright inside a recess formed at a front or a rear side of the operating means.

Preferably, the connector further comprises a locking frame provided in one piece on the resilient locking arms and engageable with a corresponding locking means provided on the second connector housing to lock the first and the second connector housings together.

Preferably, the operating means has a height greater than that of the locking frame provided on the resilient locking arms.

Preferably, the horizontal rib and the vertical rib have heights substantially flush with, or slightly greater than, those of the resilient locking arms and the operating means, respectively.

The above and other objects, features and advantages of this invention will become apparent from the following description and the appended claims, taken in conjunction with the accompanying drawings.

DESCRIPTION OF THE PREFERRED EMBODIMENTS

Embodiments of this invention will now be described with reference to the attached drawings.

Figure 1:
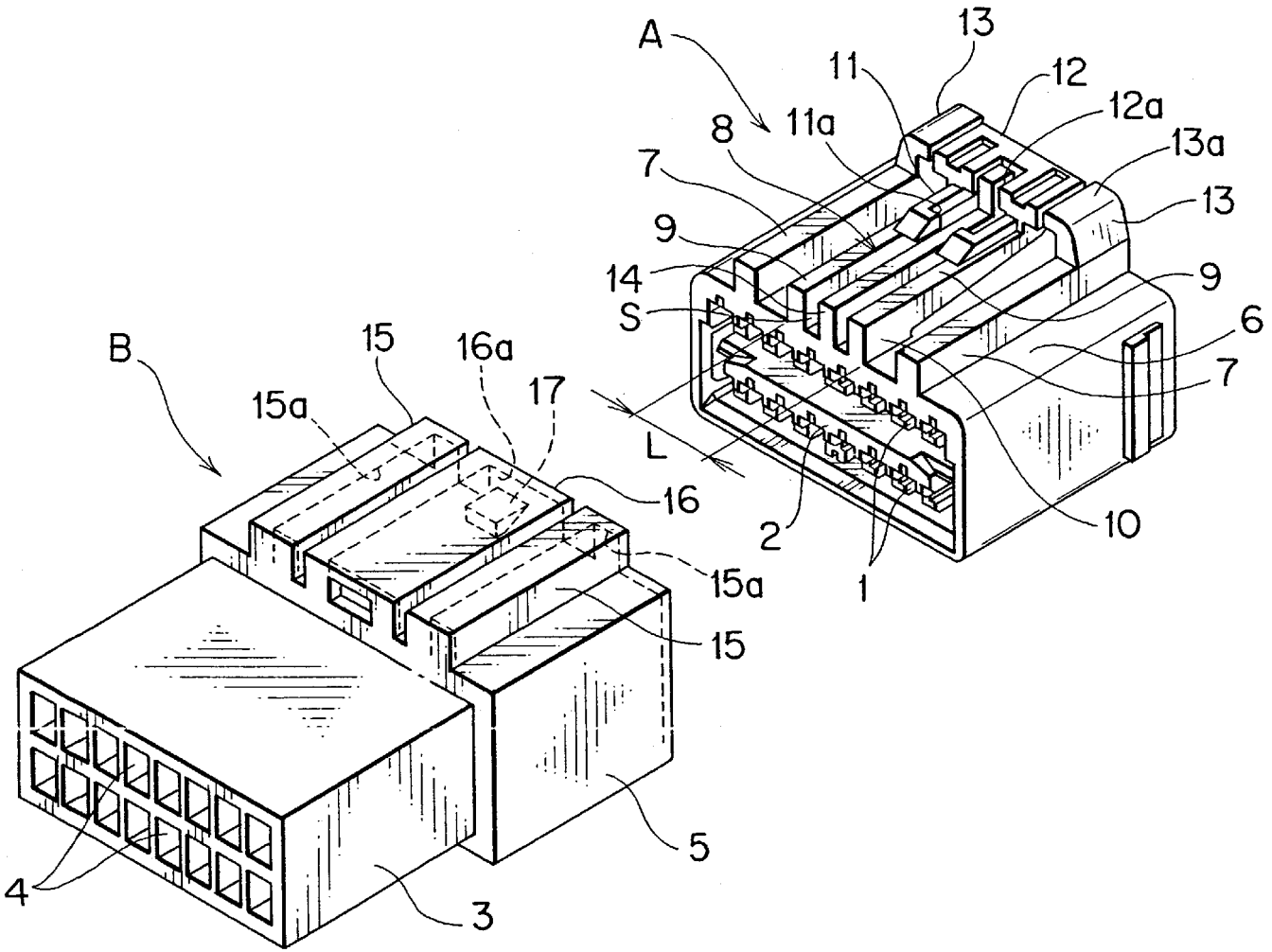
FIG. 1 is a perspective view of a pair of female and male connector housings, shown separated, according to one embodiment of this invention.

In FIGS. 1 and 2, denoted A and B are male connector housing and female connector housing, respectively, both made of synthetic resin. The male connector housing A has rows of terminal receiving cavities 1 formed therein in two tiers in which female terminal lugs (not shown) are received and locked, and a front holder 2 fitted in the housing front end opening to double-lock the female terminal lugs. The female connector housing B includes a housing body 3, terminal receiving cavities 4 formed in the housing body for receipt therein of male terminal lugs (not shown) corresponding to the female terminal lugs, and a hood 5 provided at the front of the housing body for receiving the male connector housing A.

The male connector housing A has insertion guide walls 7, 7 at left and right sides on its upper wall 6 and a pair of resilient locking arms 8 located between the insertion guide walls, the locking arms having a central space S therebetween. The insertion guide walls 7, 7 also serve as protector walls for the locking arms 8 and have a pair of opposed catching preventors 13, 13 at the rear end. Located at a center between the pair of locking arms 8 is a deformation prevention member 14.

The resilient locking arms 8, 8 rise at their forward base portions 10 and extend rearwardly, and have a pair of left and right locking segments 11 provided prominent on their top surfaces at a rear portion and an operating grip 12 provided at their rear end which integrally interconnects the locking arms 8, 8. The left and right locking segments 11 together form a locking frame 11*a*. The operating grip 12 is located at a position higher than the locking segments 11 on the arm top surfaces 9 and is pressed and released to elastically move the locking arms 8 up and down relative to the upper wall 6 of the male connector housing A. On opposite sides of the operating grip 12 are located the catching preventors 13, 13.

The catching preventors 13 are hook-shaped rigid bodies facing each other with the operating grip 12 located therebetween and each has an upper surface 13*a* flush with or higher than the operating grip 12. The deformation prevention member 14 consists of a horizontal rib 14*a* located at a center between the resilient locking arms 8, 8 and extending close to the operating grip 12 and a vertical rib 14*b* located inside a recess 12*a* formed at the front side of the operating grip 12. The horizontal rib 14*a* and the vertical rib 14*b* preferably have heights flush with, or slightly greater than, the locking arms 8, 8 and the operating grip 12, respectively.

The hood 5 of the female connector housing B has a locking chamber 16 formed at a center of its upper side for receiving the resilient locking arms 8. The locking chamber 16 is provided on its ceiling wall 16*a* with a locking projection 17 which engages in the locking frame 11 to lock the female and male connector housings B and A together. On laterally opposite sides of the locking chamber 16 are located insertion guide chambers 15 with guide grooves 15*a* formed therein for the insertion guide walls 7 of the male connector connector housing A.

With the construction as mentioned above, to fit the male connector housing A to the hood 5 of the female connector housing B, the insertion guide walls 7 are advanced into the respective guide grooves 15*a* and the resilient locking arms 8 into the locking chamber 16, during which the locking projection 17 contacts the locking frame 11 to depress the locking frame 11 and thus the locking arms 8 toward the male connector housing upper wall 6 until the locking projection 17 rides over the locking frame 11, at which time the locking frame 11 resiliently returns to its original position so that the locking projection 17 engages in the locking frame 11 to lock the male and female connector housings A and B together and to bring the female and male terminals lugs into contact with each other.

Figure 2A:
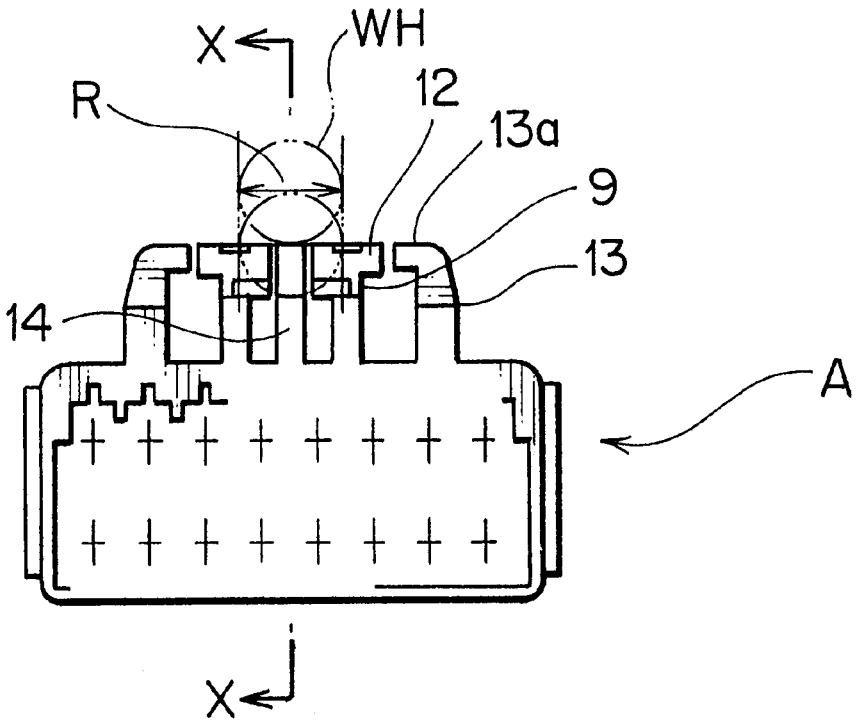
FIG. 2A is a front view of the male connector housing of FIG. 1, showing its operation.
Figure 2B:
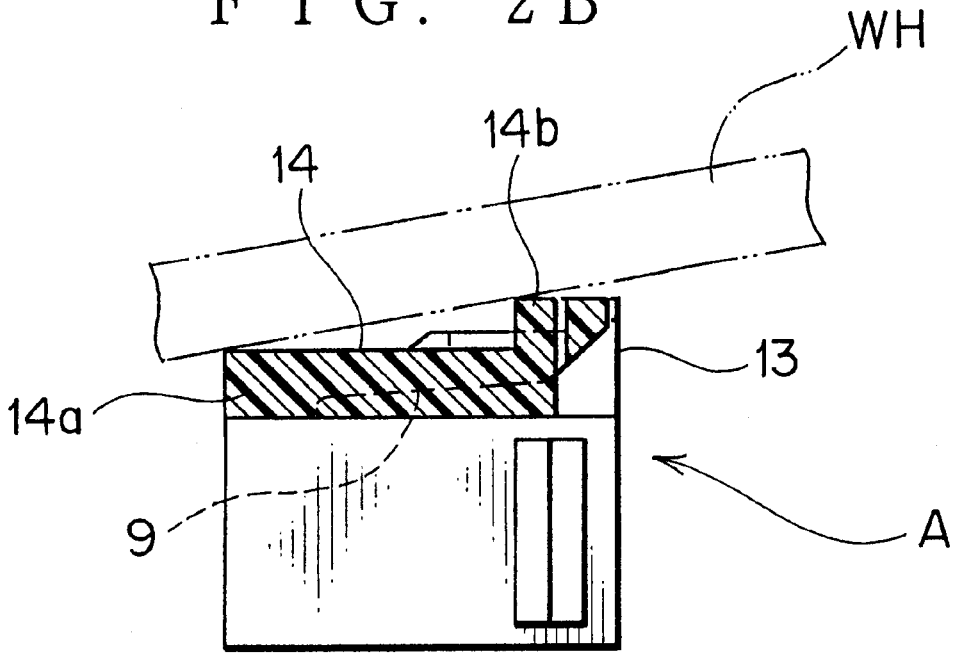
FIG. 2B is a partially sectional view taken along the line X—X of FIG. 2A.

With the male connector housing A in an unused or uncoupled condition with the female connector housing B, as shown in FIGS. 2A and 2B, if a wiring harness WH of a diameter R smaller than a locking width L between the locking arms 8, 8 is moved or pressed in parallel at the resilient locking arms 8, the wiring harness WH is stopped on the forward end of the horizontal rib 14*a* of the deformation prevention member 14 and the upper end of the vertical rib 14*b*, so that the load of the wiring harness WH does not directly act on the resilient locking arms 8. Deformation and/or collapse of the locking arms 8 by an external force is thus precluded.

In the case of a wiring harness of a diameter equal to, or greater than, the locking width L, such wiring harness will be stopped, not only by the deformation prevention member 14 but also by the catching preventors 13 to protect the resilient locking arms 8.

Figure 3:
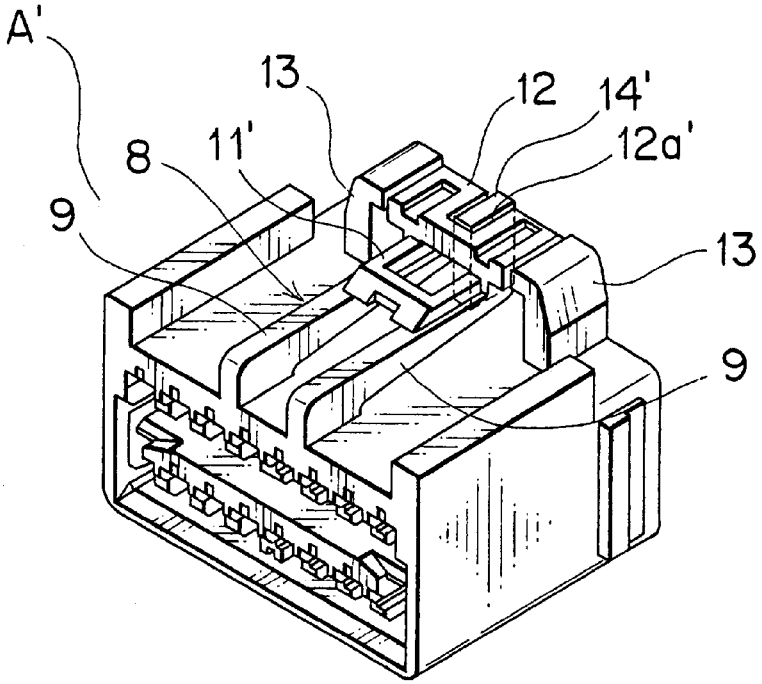
FIG. 3 is a perspective view of a male connector housing according to another embodiment of this invention.

FIG. 3 shows another embodiment of this invention. In this embodiment, a deformation prevention member 14' of a male connector housing A', with the horizontal rib 14*a* being omitted, consists of the vertical rib 14*b* which is located inside a recess 12*a*' formed at a central rear side of the operating grip 12. Since there does not exist the horizontal rib 14*a* between the pair of locking arms 8, 8, unlike the locking frame 11 in the preceding example which is made up of the locking segments 11*a*, a locking frame 11' is provided in one piece on the locking arms 8, 8. Incidentally, it is also possible to locate the deformation prevention member 14' (vertical rib 14*b*) on the front side of the operating grip 12 as in the preceding example.

With the male connector housing A', as is described in connection with FIGS. 2A and 2B, if the wiring harness WH of the diameter R is moved at the resilient locking arms 8, the wiring harness is stopped on the deformation prevention member 14' located inwardly of the operating grip 12, thereby to prevent the locking arms 8 from undue deflection toward the housing upper wall 6 and deformation and/or collapse.

Figure 4:
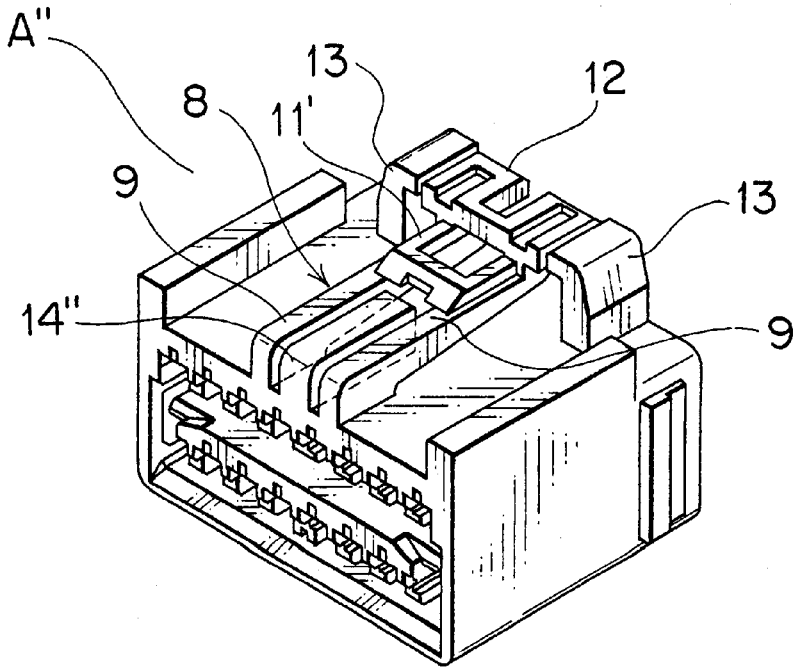
FIG. 4 is a perspective view of a male connector housing according to yet another embodiment of this invention.

FIG. 4 shows yet another embodiment of this invention in which a deformation prevention member 14" of a male connector housing A" is provided in the form of a horizontal rib located at a center between the locking arms 8, 8, the vertical rib 14*b* being omitted. The horizontal rib 14" extends up to a point close to the locking frame 11'.

With the male connector housing A", if an end of the wiring harness WH of the diameter R is moved or pressed at a front half or the forward base portion 10 side of the resilient locking arms 8, the wiring harness is stopped on the deformation prevention member 14" to thereby preclude an adverse action on the locking arms 8.

Figure 5:
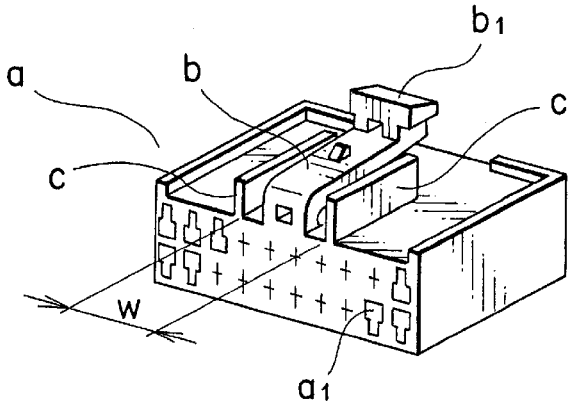
FIG. 5 PRIOR ART
FIG. 5 is a perspective view of an example of a conventional male connector housing.
Figure 6:
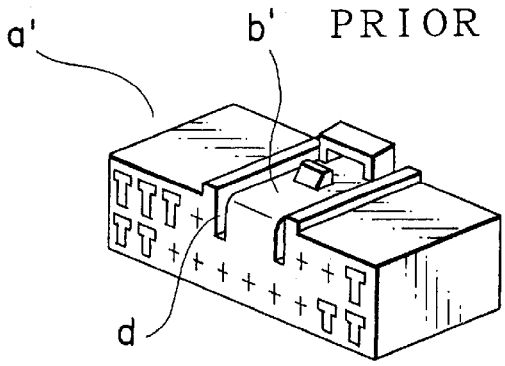
FIG. 6 PRIOR ART
FIG. 6 is a perspective view of another example of a conventional male connector housing.
Figure 7:
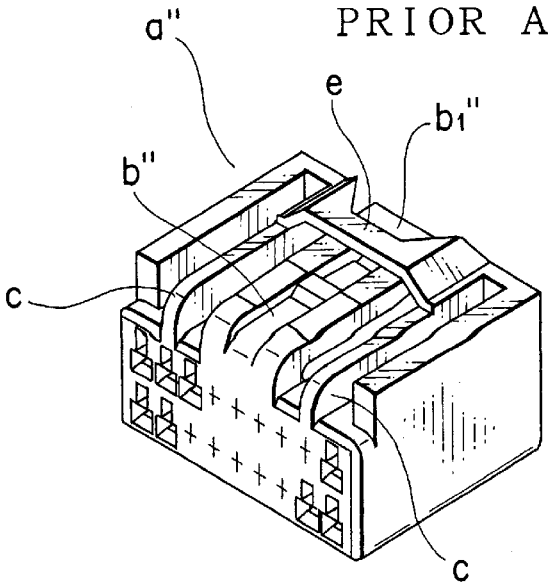
FIG. 7 PRIOR ART
FIG. 7 is a perspective view of yet another example of a conventional male connector housing.

While in the above examples, the resilient locking means is shown to be the pair of separate resilient locking arms 8, 8, it is also possible to use a single resilient locking means, such as those in FIGS. 5 and 6, especially in such a case in which the deformation prevention member 14', as shown in FIG. 3, is employed.

As mentioned hereinabove, according to this invention, because a deformation prevention member is provided on one connector housing, within a width of the resilient locking means, if an elongated object, such as a wiring harness of a diameter smaller than the width of the resilient locking means, is accidentally pressed in parallel at the locking means, its load acts on the deformation prevention member, with the result that the locking means is free of an external force which would otherwise cause unintentional depression or collapse of the locking means. Moreover, the present invention achieves the result that the connector is prevented from becoming large in size.

Having now fully described the invention, it will be apparent to one of ordinary skill in the art that many changes and modifications can be made thereto without departing from the spirit and scope of the invention as set forth herein.

What is claimed is:

1. A connector comprising:

a first connector housing fittable to a second connector housing;

a resilient locking means for locking said first and said second connector housings together, provided on an outer wall of said first connector housing, said resilient locking means rising at a forward base portion thereof and extending rearwardly in a fitting direction of said first and said second connector housing, said resilient locking means including an operating means provided at a rear end thereof for resiliently depressing said locking means with respect to said housing outer wall;

a deformation prevention means including a rigid element provided on said outer wall of said first connector housing closely adjacent said resilient locking means, and being disposed within a width of said resilient locking means, said rigid element extending from said housing outer wall a distance not less than that of said locking means in an undepressed condition for preventing an external force from depressing said resilient locking means; and catching prevention means including rigid elements provided on laterally opposite sides of said operating means for keeping said operating means from catching a foreign body.

2. A connector comprising:

a first connector housing fittable to a second connector housing;

a resilient locking means for locking said first and said second connector housings together, provided on an outer wall of said first connector housing, said resilient locking means rising at a forward base portion thereof and extending rearwardly in a fitting direction of said first and said second connector housing, said resilient locking means including an operating means provided at a rear end thereof;

a deformation prevention means provided on said outer wall of said first connector housing, within a width of said resilient locking means for preventing an external force from acting on said resilient locking means; and catching prevention means provided on laterally opposite sides of said operating means for keeping said operating means from catching a foreign body, wherein said resilient locking means comprises a pair of resilient locking arms extending parallel to each other in said fitting direction of said first and said second connector housings, said operating means interconnects said pair of resilient locking arms at an end of said locking arms, and said deformation prevention means is interposed between said pair of resilient locking arms.

3. The connector according to claim 2, wherein said deformation prevention means comprises a horizontal rib extending parallel to said resilient locking arms and a vertical rib provided at a rear end of said horizontal rib, said vertical rib standing upright on a front side of said operating means.

4. The connector according to claim 3, wherein said operating means has a recess formed at a front side thereof and said vertical rib is located standing upright inside said recess.

5. The connector according to claim 2, further comprising a pair of locking segments provided on said respective resilient locking arms and together constituting a locking frame engageable with a corresponding locking means provided on said second connector housing to lock said first and said second connector housings together.

6. The connector according to claim 2, wherein said deformation prevention means comprises a vertical rib standing upright inside a recess formed at a front or a rear side of said operating means.

7. The connector according to claim 6, further comprising a locking frame provided in one piece on said resilient locking arms and engageable with a corresponding locking means provided on said second connector housing to lock said first and said second connector housings together.

8. The connector according to claim 5, wherein said operating means has a height greater than that of said locking frame provided on said resilient locking arms.

9. The connector according to claim 3, wherein said horizontal rib and said vertical rib have heights substantially flush with or slightly greater than those of said resilient locking arms and said operating means, respectively.

* * * * *